US005375587A

United States Patent [19]

Ward et al.

[11] Patent Number: 5,375,587

[45] Date of Patent: Dec. 27, 1994

[54] OVEN DOOR APPARATUS

[76] Inventors: Shawn K. Ward; Laurie A. Ward, both of P.O. Box 192, Kylertown, Pa. 16858

[21] Appl. No.: 220,198

[22] Filed: Mar. 30, 1994

[51] Int. Cl.[5] ..... F23M 7/00; F24C 15/04

[52] U.S. Cl. ..... 126/190; 126/200; 160/201

[58] Field of Search ..... 126/190, 198, 200, 21 R, 126/19 R, 24, 201; 160/201

[56] References Cited

U.S. PATENT DOCUMENTS

| | | | |
|---|---|---|---|
| 1,578,826 | 3/1926 | Hobson | 126/190 |
| 1,740,888 | 12/1929 | Davidson | 160/201 |
| 2,109,039 | 2/1938 | Turner | 160/201 |
| 2,252,139 | 8/1941 | Schlacter | 126/190 |
| 3,091,232 | 5/1963 | Allen, Jr. et al. | 126/190 |
| 3,189,019 | 6/1965 | Pearce et al. | 126/190 |
| 3,409,003 | 11/1968 | Rehberg et al. | 126/190 |
| 3,439,668 | 4/1969 | Tilus . | |
| 4,102,322 | 7/1978 | Doner . | |
| 4,716,884 | 1/1988 | Bonaccorsi et al. . | |
| 4,732,203 | 3/1988 | Alten | 160/201 |
| 4,846,245 | 7/1989 | Pagliaro et al. . | |
| 4,927,501 | 5/1990 | Becker . | |

*Primary Examiner*—James C. Yeung

[57] ABSTRACT

A new and improved oven door apparatus includes a pair of guide channel assemblies connected to a pair of sidewalls of the oven. Each of the guide channel assemblies includes a straight vertical guide channel portion, a curved, right angled guide channel portion, and a straight horizontal guide channel portion. The straight vertical guide channel portion is connected to an oven sidewall adjacent to a front, open portion of the oven which provides access to the interior of the oven. The straight horizontal guide channel portion is connected to an oven sidewall adjacent to a top portion of the oven. An articulated door assembly includes a plurality of rectangular door panel assemblies and is connected together by articulated connection assemblies, e.g. hinge assemblies. A wheel assembly is positioned adjacent to each corner of each door panel assembly. Wheels ride in the guide channel assemblies. The bottommost of the door panel assemblies includes a handle. A first gasket assembly is located between the bottommost door panel assembly and a bottom portion of the oven. Inter-door-panel-assembly sealing elements, supported on edge surfaces of adjacent door panel assemblies, provide seals between adjacent door panel assemblies when the articulated door assembly is in a closed orientation. One of the door panel assemblies includes a transparent portion, e.g. glass panel, which permits a person to view inside the oven without opening the oven door.

9 Claims, 4 Drawing Sheets

OVEN DOOR APPARATUS

BACKGROUND OF THE INVENTION

1. Field of the Invention

The present invention relates generally to ovens and, more particularly, to doors for ovens.

2. Description of the Prior Art

Gas powered and electric powered general purpose cooking ranges generally include a number of top burners and an interior oven. The oven is generally accessed through a door which includes a single rigid door panel which has a top side and a bottom side. The top side generally has a handle, and the bottom side includes part of a hinge assembly connected to the framework or body of the range in a fixed position. The hinge assembly is oriented horizontally on the range body, and when the door handle is pulled, the door opens by rotating around the fixed, horizontally oriented hinge assembly. A number of disadvantages are associated with this type of oven door which includes a fixed, horizontal hinge assembly connected between a bottom side of an oven door and the body of the oven.

With respect to one disadvantage of a bottom-side, fixed hinge oven door, when a bottom-side, fixed hinge door is opened, heated air in the top region of the oven easily escapes from the interior of the oven. It is a well known fact that hot air rises. When the bottom-side, fixed hinge door is opened, a portion of the heated air in the top region of the oven rises out of the oven, escaping from the oven. Such an escape of heated oven air is wasteful of energy. In this respect, it would be desirable if an oven door were provided which impedes the loss of heated air from the oven when the oven door is opened.

With respect to another disadvantage of a bottom-side, fixed hinge oven door, when such a door is opened, as the door swings around the fixed hinge, a partial vacuum is created in the oven which draws unheated outside air into the oven. The outside air mixes with the inside oven air to reduce oven temperature, which, in turn requires further heating. In this respect, it would be desirable if an oven door were provided which does not create a vacuum inside the oven which draws in unheated outside air when the oven door is opened.

With respect to yet another disadvantage of a bottom-side, fixed hinge oven door, when such a door is opened, the person opening the door often places one's head near the top side of the door to gain a good view of the interior of the oven to check on the food being heated therein. When the conventional door is opened, the hot air that escapes from the top region of the oven may give the person a blast of hot air that may cause irritation or burning. In this respect, it would be desirable if an oven door were provided which prevents an unsafe blast of hot air from escaping from the top region of an oven when the oven door is opened.

Conventional oven doors generally include opaque portions and transparent portions which permit a person to view the interior of the oven without opening the oven door. Such a transparent portion is very desirable, and it would be desirable if an oven door were provided which includes a transparent portion that permits the interior of the oven to be viewed without opening the oven door.

Aside from the step of opening an oven door, heated air within an oven often escapes from the oven around edges of a closed oven door. In fact, although the door is closed, edges of the door may not be adequately sealed with respect to the body of the oven. In this respect, it would be desirable if an oven door were provided which includes a sealing assembly between the oven door and the body of the oven.

One reason why conventional bottom-side, fixed hinge oven doors tend to be inadequately sealed relates to the fact that the center of gravity of the door is located above the bottom-side, fixed hinge. As a result, under the influence of the force of gravity, the oven door may tend to swing open in rotation around the bottom-side, fixed hinge under its own weight, without its handle being pulled by a person. Thus, in such a case, the force of gravity tends to open the oven door when it is desired for the oven door to remain closed. In this respect, it would be desirable if an oven door were provided which tends to remain closed under the influence of the force of gravity.

Throughout the years, a number of innovations have been developed relating to oven doors, and the following U.S. patents are representative of some of those innovations: U.S. Pat. Nos. 3,439,668; 4,102,322; 4,716,884; 4,846,245; and 4,927,501. In spite of their differences, all of the cited patents appear to disclose oven doors that have one common feature; they disclose bottom-side, fixed hinge oven doors.

Still other features would be desirable in an oven door apparatus. For example, since oven doors are exposed to high temperatures, it would be desirable for the components of the oven doors to be high temperature resistant.

Ovens, in three-dimensional space, have a width, a height, and a depth. Similarly, oven doors have a width, a height, and a depth. Although the oven and oven door dimensions can be varied through a wide spectrum of proportions, it is preferred that the height of a closed oven door be less than the depth of the oven.

Thus, while the foregoing body of prior art indicates it to be well known to use oven doors, the prior art described above does not teach or suggest an oven door apparatus which has the following combination of desirable features: (1) impedes the loss of heated air from the oven when the oven door is opened; (2) does not create a vacuum inside the oven which draws in unheated outside air when the oven door is opened; (3) prevents an unsafe blast of hot air from escaping from the top region of an oven when the oven door is opened; (4) includes a transparent portion that permits the interior of the oven to be viewed without opening the oven door; (5) includes a sealing assembly between the oven door and the body of the oven; (6) tends to remain closed under the influence of the force of gravity; (7) includes oven door components that are resistant to high temperatures; and (8) has a height of the closed oven door which is less than the depth of the oven. The foregoing desired characteristics are provided by the unique oven door apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved oven door apparatus for an oven which has a pair of sidewalls spaced from each other by a predetermined distance, which has a floor located between the pair of sidewalls, and which has a depth. The oven door apparatus includes a Fair of guide channel assemblies connected to the pair of sidewalls of the oven. Each of the guide channel assemblies includes a straight vertical guide channel portion, a curved, right angled guide channel portion connected to the straight vertical guide channel portion, and a straight horizontal guide channel portion connected to the curved, right angled guide channel portion. The straight vertical guide channel portion is connected to a sidewall of the oven adjacent to a front, open portion of the oven which provides access to the interior of the oven. The straight horizontal guide channel portion is connected to a sidewall of the oven adjacent to a top portion of the oven. An articulated door assembly, which includes a plurality of door panel assemblies, is connected together by articulated connection assemblies. Each door panel assembly includes foul- corners. Each door panel assembly includes a wheel assembly adjacent to each of the four corners. The wheel assemblies are adapted to ride in the guide channel assemblies. The articulated door assembly has a height in a closed orientation, and the height of the closed articulated door assembly is less than the depth of the oven.

The bottommost of the door panel assemblies includes a handle. A first gasket assembly located between a bottommost edge of a bottommost door panel assembly and a bottom portion of the oven.

Inter-door-panel-assembly scaling elements, supported on edge surfaces of adjacent door panel assemblies, provide seals between adjacent door panel assemblies when the articulated door assembly is in a closed orientation.

The articulated connection assemblies connect adjacent door panel assemblies together. The articulated connection assemblies include hinge assemblies connected between adjacent door panel assemblies. The hinge assemblies are connected at inside edges of the door panel assemblies.

Each wheel assembly includes a wheel fabricated from heat-resistant materials which may be a heat-resistant thermosetting plastic material or a heat-resistant ceramic material. Each wheel assembly includes a base plate, an axle attached to the base plate, and a wheel supported on the axle.

One of the door panel assemblies includes a transparent portion which permits a person to view inside the oven when the articulated door assembly is in a closed orientation. The transparent portion of the door panel assembly includes heat-resistant glass panels. The door panel assembly which includes the transparent portion includes a frame assembly for supporting the transparent portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved oven door apparatus which has all of the advantages of the prior art and none of the disadvantages.

It is another object of the present invention to provide a new and improved oven door apparatus which may be easily and efficiently manufactured and marketed.

It is a further object of the present invention to provide a new and improved oven door apparatus which is of durable and reliable construction.

An even further object of the present invention is to provide a new and improved oven door apparatus which is susceptible of a low cost of manufacture with regard to both materials and labor, and which accordingly is then susceptible of low prices of sale to the consuming public, thereby making such oven door apparatus available to the buying public.

Still yet a further object of the present invention is to provide a new and improved oven door apparatus which impedes the loss of heated air from the oven when the oven door is opened.

Still another object of the present invention is to provide a new and improved oven door apparatus that does not create a vacuum inside the oven which draws in unheated outside air when the oven door is opened.

Yet another object of the present invention is to provide a new and improved oven door apparatus which prevents an unsafe blast of hot air from escaping from the top region of an oven when the oven door is opened.

Even another object of the present invention is to provide a new and improved oven door apparatus that includes a transparent portion that permits the interior of the oven to be viewed without opening the oven door.

Still a further object of the present invention is to provide a new and improved oven door apparatus which includes a sealing assembly between the oven door and the body of the oven.

Yet another object of the present invention is to provide a new and improved oven door apparatus that tends to remain closed under the influence of the force of gravity.

Still another object of the present invention is to provide a new and improved oven door apparatus which includes oven door components that are resistant to high temperatures.

Yet another object of the present invention is to provide a new and improved oven door apparatus wherein the height of the closed oven door is less than the depth of the oven.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
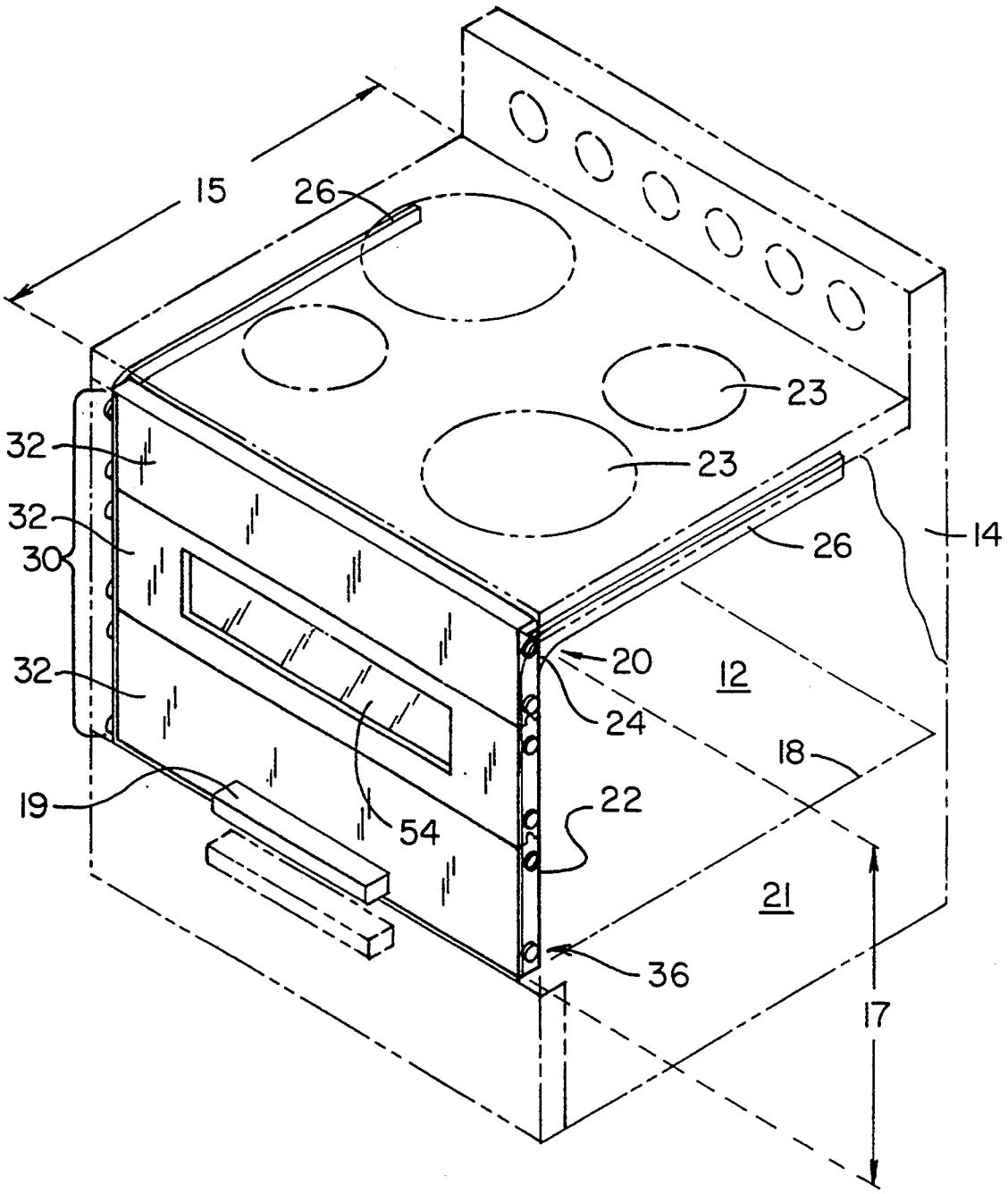
FIG. 1 is a perspective view showing a preferred embodiment of the oven door apparatus of the invention installed in a general purpose range.
Figure 2:
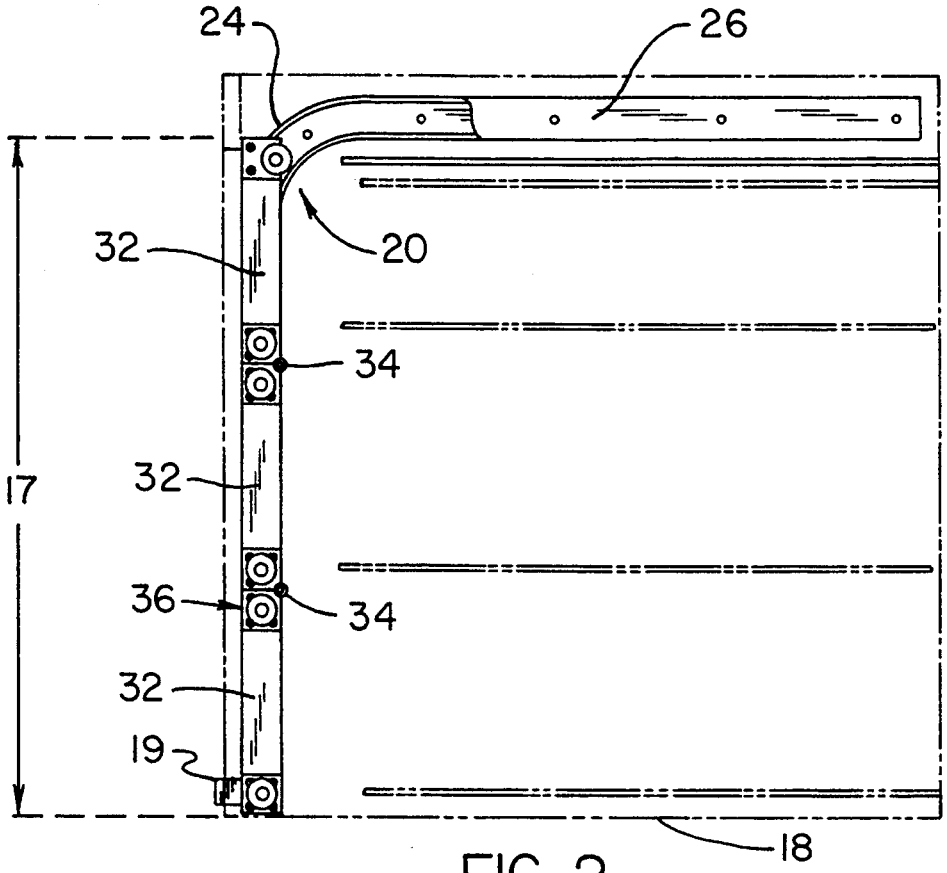
FIG. 2 is an enlarged, partially broken away side view of the embodiment of the oven door apparatus of the invention installed in the general purpose range shown in FIG. 1.
Figure 3:
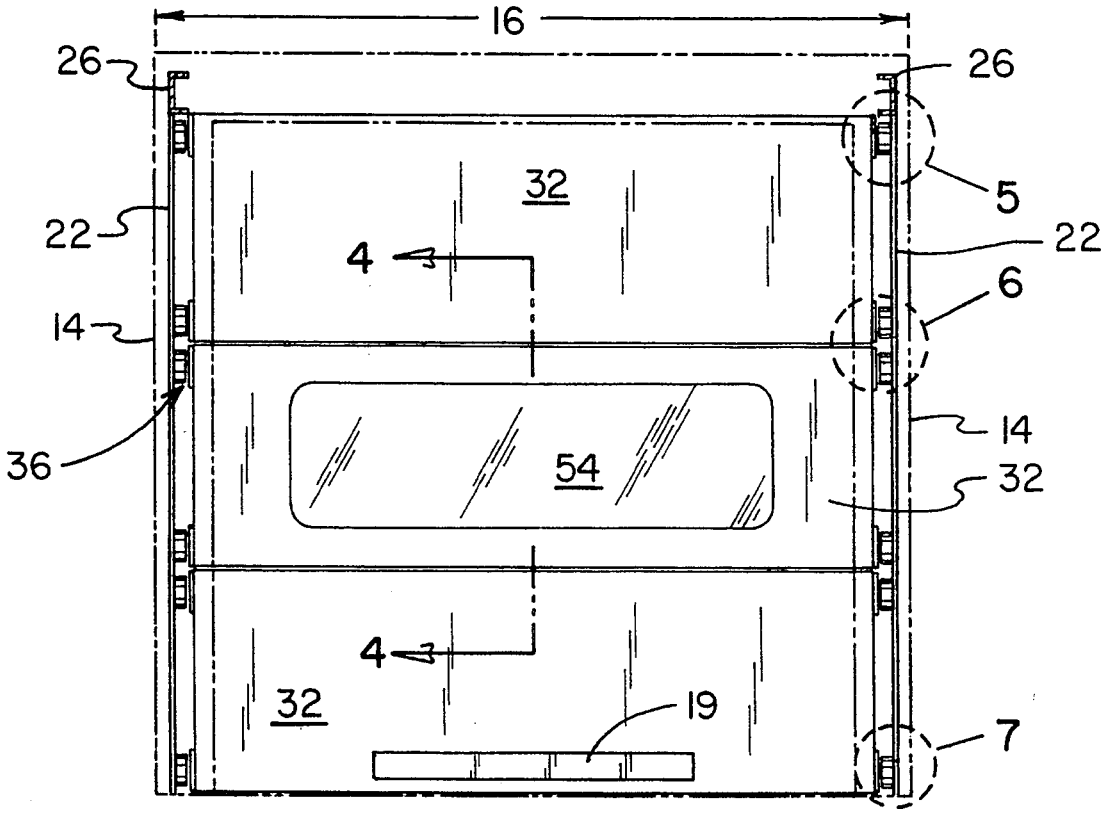
FIG. 3 is a partially broken away front view of the embodiment of the oven door apparatus of the invention shown in FIG. 2.

With reference to the drawings, a new and improved oven door apparatus embodying the principles and concepts of the present invention will be described.

Turning to FIGS. 1–7, there is shown an exemplary embodiment of the oven door apparatus of the invention generally designated by reference numeral 10. In its preferred form, oven door apparatus 10 is provided for an oven 12 which has a pair of sidewalls 14 spaced from each other by a predetermined distance 16, which has a floor 18 located between the pair of sidewalls 14, and which has a depth 15. The oven door apparatus 10 includes a pair of guide channel assemblies 20 connected to the pair of sidewalls 14 of the oven 12. Each of the guide channel assemblies 20 includes a straight vertical guide channel portion 22, a curved, right angled guide channel portion 24 connected to the straight vertical guide channel portion 22, and a straight horizontal guide channel portion 26 connected to the curved, right angled guide channel portion 24. The straight vertical guide channel portion 22 is connected to a sidewall 14 of the oven 12 adjacent to a front, open portion of the oven 12 which provides access to the interior of the oven 12. The straight horizontal guide channel portion 26 is connected to a sidewall 14 of the oven 12 adjacent to a top portion of the oven 12. An articulated door assembly 30, which includes a plurality of door panel assemblies 32, is connected together by articulated connection assemblies 34. Each door panel assembly 32 includes four comers. Each door panel assembly 32 includes a wheel assembly 36 adjacent to each of the four corners. The wheel assemblies 36 are adapted to ride in the guide channel assemblies 20. The articulated door assembly 30 has a height 17 in a closed orientation, and the height 17 of the closed articulated door assembly 30 is less than the depth 15 of the oven 12.

As shown in greatest detail in FIG. 1, a general purpose range includes a broiler region 21 located below the oven 12. In addition, burner assemblies 23 are located above the oven 12.

The bottommost of the door panel assemblies 32 includes a handle 19. As shown in greatest detail in FIG. 7, a first gasket assembly 37 is located between a bottommost edge of a bottommost door panel assembly 32 and a bottom portion of the oven 12. A second gasket assembly may be located between the articulated door assembly 30 when in a closed orientation and a portion of an oven body adjacent to the articulated door assembly 30 when in a closed orientation. The second gasket assembly provides a seal between the oven body and the articulated door assembly 30 when the articulated door assembly 30 is in a closed orientation.

Figure 4:
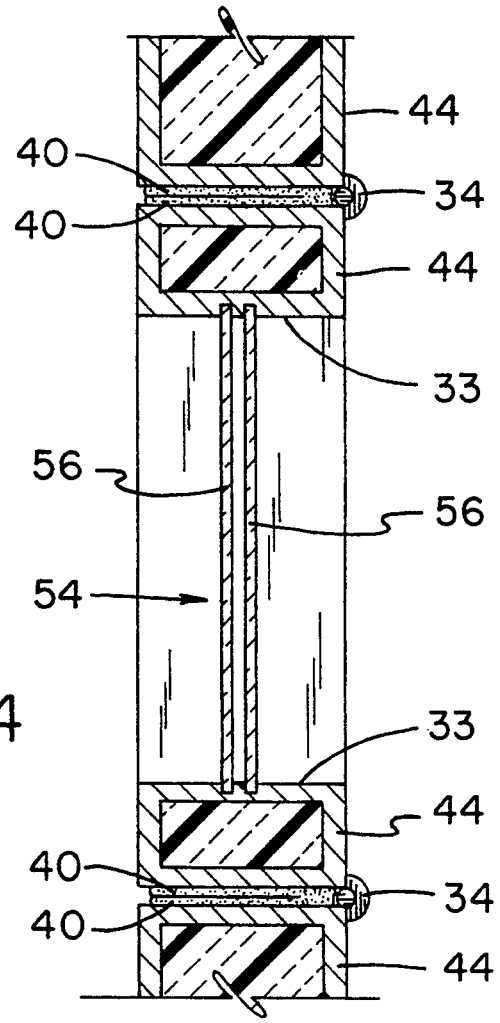
FIG. 4 is an enlarged cross-sectional view of the embodiment of the invention shown in FIG. 3 taken along line 4—4 in FIG. 3.
Figure 6:
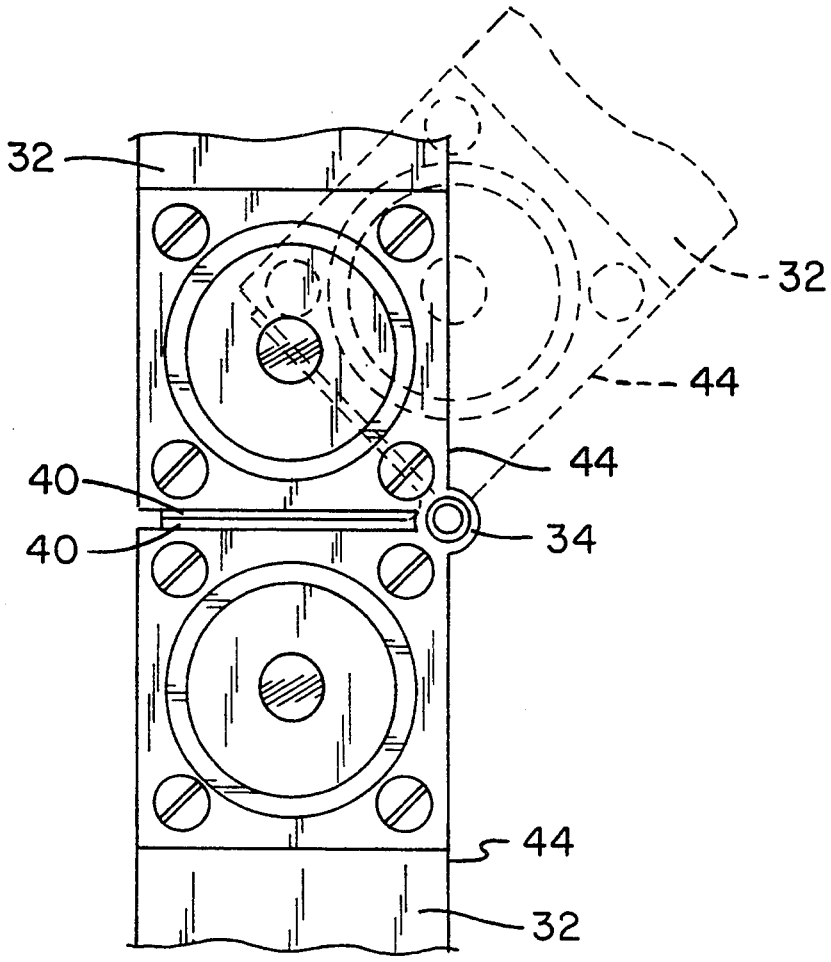
FIG. 6 is an enlarged side view of the portion of the embodiment of the invention shown in FIG. 3 that is shown in the circled region 6 of FIG. 3.
Figure 7:
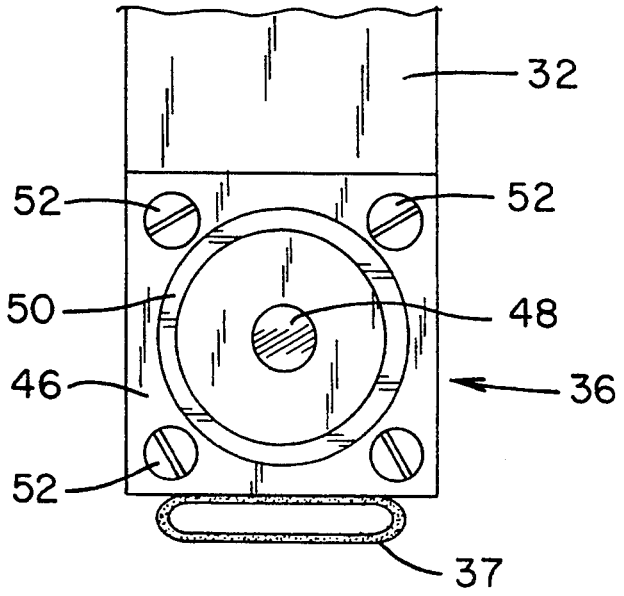
FIG. 7 is an enlarged side view of the portion of the embodiment of the invention shown in FIG. 3 that is shown in the circled region 7 of FIG. 3.

As shown in greatest detail in FIGS. 4 and 6, inter-door-panel-assembly sealing elements 40, supported on edge surfaces 42 of adjacent door panel assemblies 32, provide seals between adjacent door panel assemblies 32 when the articulated door assembly 30 is in a closed orientation.

As shown in FIGS. 4 and 6, inter-door-panel-assembly sealing elements 40 on adjacent horizontal edges of adjacent door panel assemblies 32 are automatically aligned with each other and compressed against each other when the door panel assemblies 32 are in a closed orientation; that is when adjacent edges of adjacent door panel assemblies 32 are juxtaposed with each other in a horizontal orientation. More specifically, the inter-door-panel-assembly sealing elements 40 are automatically aligned with each other and compressed against each other under the influence of gravity when the hinge assemblies 34 move from the curved, right angled guide channel portions 24 of the guide channel assemblies 20 to the straight vertical guide channel portions 22 of the guide channel assemblies 20.

The articulated connection assemblies 34 connect adjacent door panel assemblies 32 together. The articulated connection assemblies 34 include hinge assemblies 34 connected between adjacent door panel assemblies 32. Alternatively, the hinge assemblies 34 can include ball and socket joints between adjacent door panel assemblies 32. The hinge assemblies 34 are connected at inside edges 44 of the door panel assemblies 32.

Each wheel assembly 36 includes a wheel 50 fabricated from heat-resistant materials which may be a heat-resistant thermosetting plastic material such as Bakelite(TM) or a heat-resistant ceramic material.

Figure 5:
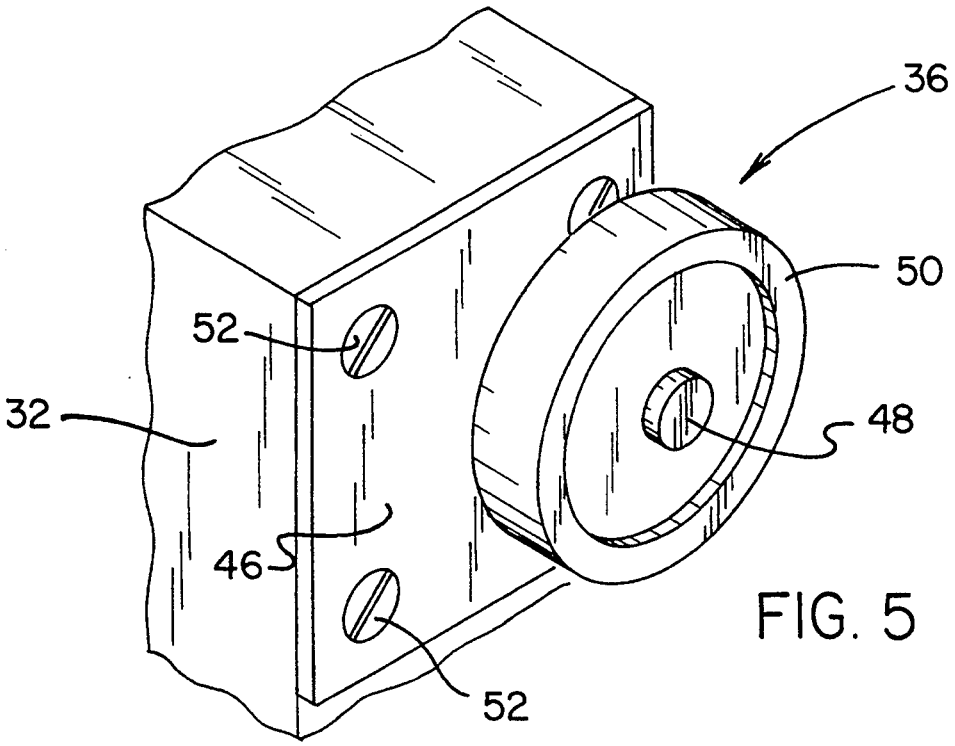
FIG. 5 is an enlarged perspective view of the portion of the embodiment of the invention shown in FIG. 3 that is shown in the circled region 5 of FIG. 3.

As shown in greatest detail in FIG. 5, each wheel assembly 36 includes a base plate 46, an axle 48 attached to the base plate 46, and a wheel 50 supported on the axle 48. The base plate 46 includes a number of apertures through which fasteners, e.g. screws 52, are placed to attach the wheel assembly 36 to a respective door panel assembly 32.

As shown in greatest detail in FIG. 4, one of the door panel assemblies 32 includes a transparent portion 54 which permits a person to view inside the oven 12 when the articulated door assembly 30 is in a closed orientation. The transparent portion 54 of the door panel assembly 32 includes heat-resistant glass panels 56. The door panel assembly 32 which includes the transparent portion 54 includes a frame assembly 33 for supporting the transparent portion 54.

In operation, when the oven door apparatus 10 of the invention is in a closed position, as shown in FIG. 1, the handle 19 is grasped by a person, and the handle 19 is pulled upward. As the handle 19 is pulled upward, the wheels 50 of the wheel assemblies 36 roll upward in the straight vertical guide channel portions 22 of the guide channel assemblies 20. The wheels 50 traverse the curved, right angled guide channel portions 24 and enter the straight horizontal guide channel portion 26 of the guide channel assemblies 20. When the wheels 50 traverse the curved, right angled guide channel portions 24, adjacent door panel assemblies 32 rotate around the hinge assemblies 34 is connected therebetween. See the broken line figure in FIG. 6.

When the oven door apparatus 10 of the invention is in a fully open position, the entire articulated door assembly 30 is supported in a horizontal orientation by the straight horizontal guide channel portions 26 of the guide channel assemblies 20. In contrast, when the oven door apparatus 10 of the invention is in a fully closed position, the entire articulated door assembly 30 is maintained in a vertical orientation by the straight vertical guide channel portions 22 of the guide channel assemblies 20. The full weight of the articulated door assembly 30 is supported by the first gasket assembly 37 when the articulated door assembly 30 is in the fully closed orientation.

When the oven door apparatus 10 of the invention is only partially opened, the bottommost of the door panel assemblies 32 is partially lifted off of the floor 18 of the oven 12. In this partially open position, only the bottom portion of the oven is exposed to room air. The top portion of the oven 12 is not exposed to room air when the articulated door assembly 30 is only partially open. Moreover, in opening the articulated door assembly 30 of the invention, a partial vacuum is not created in the oven 12.

Although the components of the oven door apparatus 10 of the invention can be any suitable size, the following sizes are deemed to be eminently suitable. Each door panel assembly 32 can be approximately 6.5 inches high and approximately 29 inches wide. The transparent glass portion 54 can be 3 inches by 16 inches.

Although any suitable number of door panel assemblies 32 can be employed for each articulated door assembly 30, it is especially desirable for three door panel assemblies 32 to be employed. It is preferred that the middle door panel assembly 32 contain the transparent glass portion 54.

The components of the oven door apparatus of the invention can be made from inexpensive and durable heat-resistant metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved oven door apparatus that is low in cost, relatively simple in design and operation, and which may advantageously be used to impede the loss of heated air from the oven when the oven door is opened. With the invention, an oven door apparatus is provided which does not create a vacuum inside the oven which draws in unheated outside air when the oven door is opened. With the invention, an oven door apparatus is provided which prevents an unsafe blast of hot air from escaping from the top region of an oven when the oven door is opened. With the invention, an oven door apparatus is provided which includes a transparent portion that permits the interior of the oven to be viewed without opening the oven door. With the invention, an oven door apparatus is provided which includes a sealing assembly between the oven door and the body of the oven. With the invention, an oven door apparatus is provided which tends to remain closed under the influence of the force of gravity. With the invention, an oven door apparatus is provided which includes oven door components that are resistant to high temperatures. With the invention, an oven door apparatus is provided wherein the height of the closed oven door is less than the depth of the oven.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A new and improved oven door apparatus for an oven which has a pair of sidewalls spaced from each other by a predetermined distance, which has a floor located between the pair of sidewalls, and which has a depth, comprising:

a pair of guide channel assemblies connected to the pair of sidewalls of the oven, wherein each of said guide channel assemblies includes a straight vertical guide channel portion, a curved, right angled guide channel portion connected to said straight vertical guide channel portion, and a straight horizontal guide channel portion connected to said curved, right angled guide channel portion, wherein said straight vertical guide channel portion is connected to a sidewall of the oven adjacent to a front, open portion of the oven and wherein said straight horizontal guide channel portion is connected to a sidewall of the oven adjacent to a top portion of the oven, an articulated door assembly which includes a plurality of door panel assemblies connected together by articulated connection assemblies, wherein each door panel assembly includes four corners and wherein each door panel assembly includes a wheel assembly adjacent to each of said four corners, wherein said wheel assemblies are adapted to ride in said guide channel assemblies, wherein said articulated door assembly has a height in a closed orientation, and wherein said height of said closed articulated door assembly is less than the depth of the oven, a first gasket assembly located between a bottommost edge of a bottommost door panel assembly and a bottom portion of the oven, inter-door-panel-assembly sealing elements, supported on edge surfaces of adjacent door panel assemblies, for providing seals between adjacent door panel assemblies when said articulated door assembly is in a closed orientation, wherein said articulated connection assemblies connect adjacent door panel assemblies together, wherein said articulated connection assemblies include hinge assemblies connected between adjacent door panel assemblies, wherein said hinge assemblies are connected at inside edges of said door panel assemblies, wherein said inter-door-panel-assembly sealing elements are located on adjacent horizontal edges of adjacent door panel assemblies, wherein adjacent inter-door-panel-assembly sealing elements are automatically aligned with each other and automatically compressed against each other under a gravity influence when said door panel assemblies are in a closed orientation when adjacent edges of adjacent door panel assemblies are juxtaposed with each other in a horizontal orientation, wherein said inter-door-panel-assembly sealing elements are automatically aligned with each other and automatically compressed against each other under a gravity influence when said hinge assemblies move from said curved, right angled guide channel portion of said guide channel assemblies to said straight vertical guide channel portion of said guide channel assemblies.

2. The apparatus described in claim 1 wherein one of said door panel assemblies includes a handle.

3. The apparatus described in claim 1 wherein each wheel assembly includes a wheel fabricated from heat-resistant materials.

4. The apparatus described in claim 3 wherein a wheel is fabricated from a heat-resistant thermosetting plastic material.

5. The apparatus described in claim 3 wherein a wheel is fabricated from a heat-resistant ceramic material.

6. The apparatus described in claim 1 wherein each wheel assembly includes:

a base plate, an axle attached to said base plate, and a wheel supported on said axle.

7. The apparatus described in claim 1 wherein one of said door panel assemblies includes a transparent portion which permits a person to view inside oven when said articulated door assembly is in a closed orientation.

8. The apparatus described in claim 7 wherein said transparent portion of said door panel assembly includes heat-resistant glass panels.

9. The apparatus described in claim 8 wherein said door panel assembly which includes said transparent portion includes a frame assembly for supporting said transparent portion.

* * * * *